United States Patent [19]

Eberhardt et al.

[11] Patent Number: 4,653,978

[45] Date of Patent: Mar. 31, 1987

[54] RELIEF VALVE SYSTEM

[75] Inventors: H. Alfred Eberhardt, Paoli; Kenneth F. Hoffman, Schwenksville, both of Pa.

[73] Assignee: Hale Fire Pump Company, Conshohocken, Pa.

[21] Appl. No.: 632,282

[22] Filed: Jul. 19, 1984

[51] Int. Cl.[4] ..... F01B 25/10

[52] U.S. Cl. ..... 415/39; 415/11; 415/26; 415/145

[58] Field of Search ..... 415/11, 26–28, 415/39, 145, 147; 417/307, 279

[56] References Cited

U.S. PATENT DOCUMENTS

| | | | |
|---|---|---|---|
| 2,470,565 | 5/1949 | Loss | 415/11 |
| 2,819,836 | 1/1958 | Eberle | 415/145 |
| 3,110,264 | 11/1963 | Smith | 415/145 |

FOREIGN PATENT DOCUMENTS

| | | | |
|---|---|---|---|
| 60511 | 11/1954 | France | 415/145 |
| 1383467 | 2/1975 | United Kingdom | 415/145 |

*Primary Examiner*—Robert E. Garrett
*Assistant Examiner*—John Kwon
*Attorney, Agent, or Firm*—Frank A. Follmer

[57] ABSTRACT

A relief valve system for a pump in which control means are responsive to the occurrence of an excessive pressure on the inlet or discharge side of the pump to relieve this condition by dumping excess pressure to atmosphere.

14 Claims, 5 Drawing Figures

FIG. 3
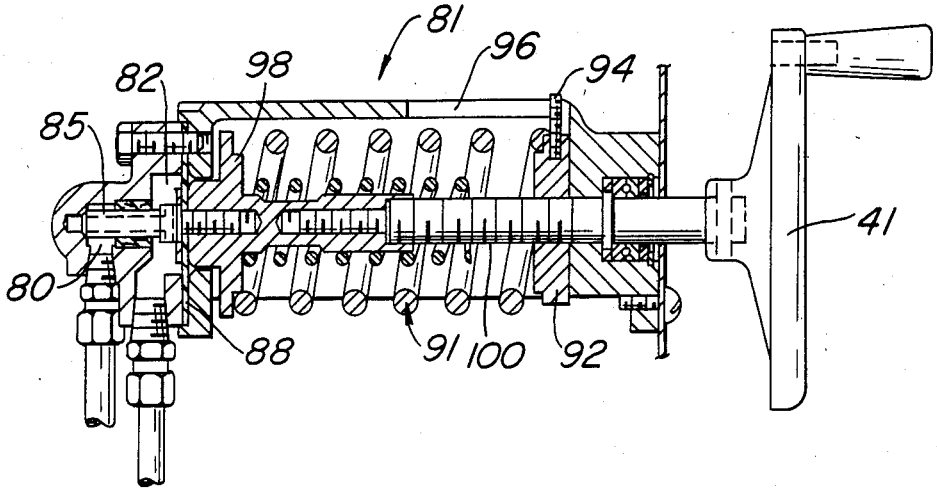
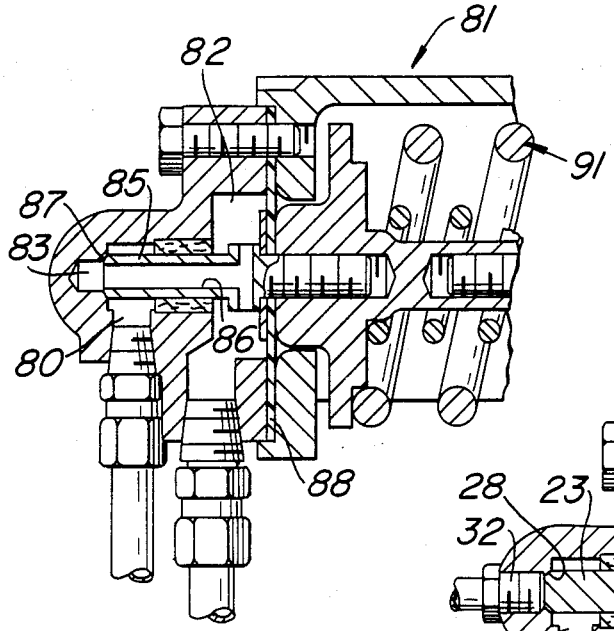
FIG. 4
FIG. 5
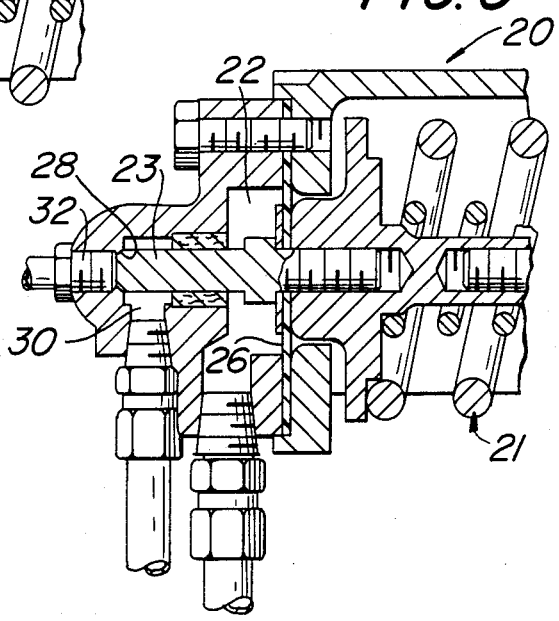

RELIEF VALVE SYSTEM

BACKGROUND AND SUMMARY OF THE INVENTION

This invention relates generally to a relief valve system for controlling the pressure on both the discharge and inlet side of a pump.

The relief valve system of the invention provides the complete pressure protection that is not available with the conventional systems which generally comprise a recirculating relief valve or an engine governor. Occasionally, a separate dump relief valve is additionally installed on the inlet side for pump inlet pressure relief. The conventional recirculating relief valves simply dump excess water back to the inlet side of the pump to relieve pressure. This arrangement is satisfactory under conditions where the intake pressure is considerably less than the discharge pressure. However, in actual practice, such as in firefighting applications, this may not be the case. For example, there may be a strong (high pressure) hydrant water supply to the pump, or the pump may be included in a pump relay hook-up. It is especially important to relieve excessive pressure conditions on pumps used in firefighting because an excessive pressure could create an unsafe condition for the hose operator.

While an engine governor throttles back the engine to reduce the discharge pressure, this also may not completely compensate for the high incoming pressure so that additional pressure relief means are necessary.

Also, while a suction dump valve will partially counteract the above-described problems of conventional systems, such a dump valve is limited because it is usually preset and cannot be easily adjusted to compensate for all the pumping conditions under which the pump must be used.

The relief valve system in accordance with the invention comprises control means which are responsive to the occurrence of an excessive pressure on the inlet or discharge side of the pump to relieve this condition by dumping excess pressure to atmosphere. In one system a novel control means is arranged to control a relief valve on the inlet side of the pump so as to dump the inlet flow to atmosphere. In another system a relief valve is controlled to dump the discharge flow to atmosphere. It is noted that locating the relief valve on the discharge side of the pump eliminates problems that frequently occur with suction side dump valves, such as clogging with debris and sticking open so as to subsequently interfere with priming of the pump.

BRIEF DESCRIPTION OF THE DRAWINGS

FIG. 3 is a detail view of a control valve used in the systems of FIGS. 1 and 2.

FIG. 4 is a fragmentary view of part of the control valve shown in FIG. 3.

FIG. 5 is a fragmentary view of part of another control valve used in the systems of FIGS. 1 and 2.

DETAILED DESCRIPTION OF THE PREFERRED EMBODIMENTS

Figure 1:
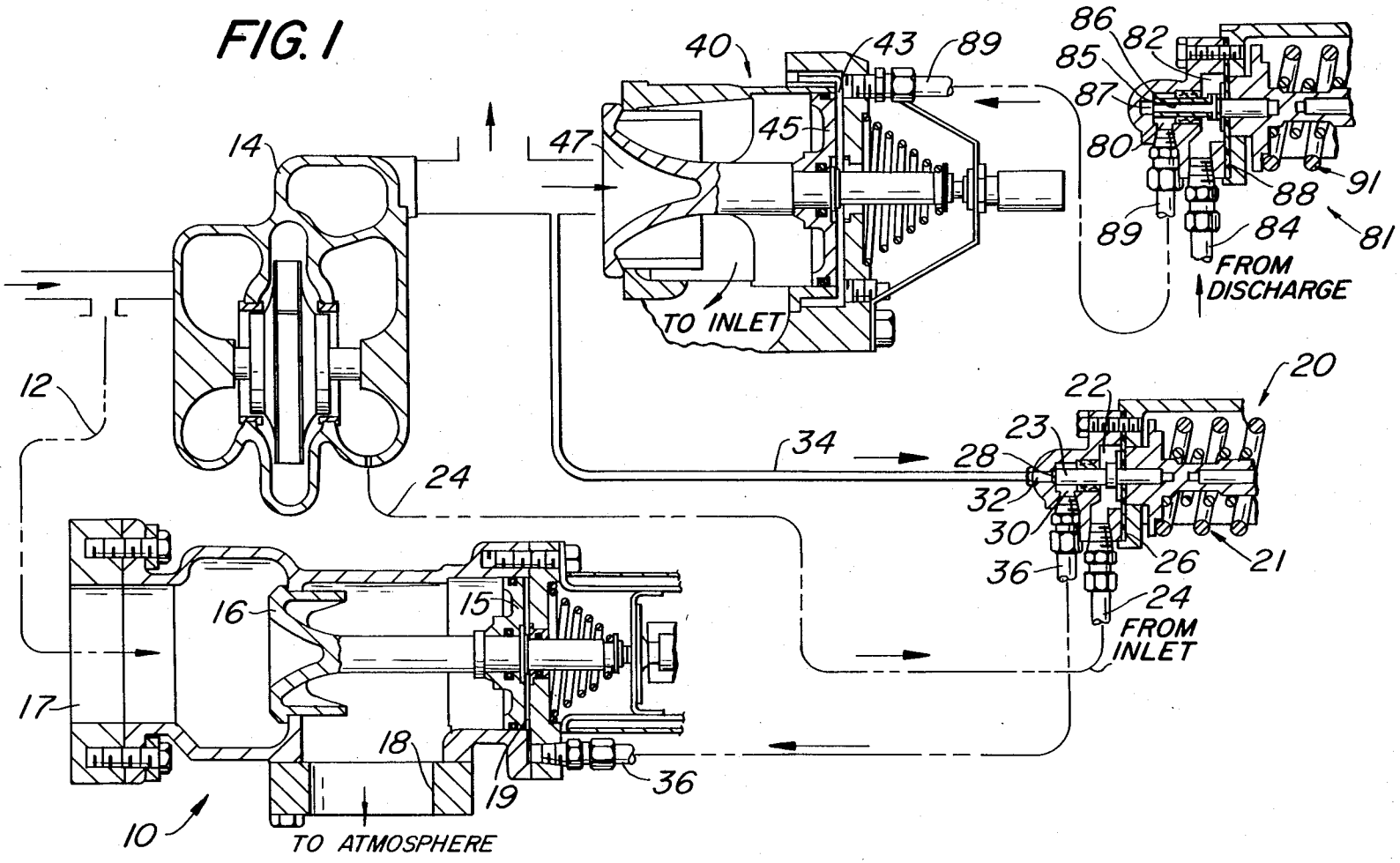
FIG. 1 is a schematic illustration of one relief valve system in accordance with the invention.

In FIG. 1 there is shown one relief valve system in accordance with the invention. This system comprises a relief valve 10 which is connected through line 12 to the flow to the inlet side of a centrifugal pump 14. The relief valve 10 has a valve member 16 operated by a piston 15 which is responsive to a control pressure applied to a piston actuating chamber 19 to move valve member 16 from a closed position (shown in FIG. 1) to an open position wherein a part of the pump inlet flow passes through line 12, through an inlet passage 17, past valve member 16 to an outlet passage 18 which dumps the flow to atmosphere.

There is provided a control valve 20 which has a pressure control chamber 22 connected by line 24 to a location to sense the pressure on the inlet side (also known as the "suction") of the pump 14. A valve member 23 connected to a pressure responsive diaphragm 26 cooperates with a valve seat 28 to control flow between a pair of flow passages 30 and 32 in the control valve 20 (see FIG. 5). Passage 32 is connected by a line 34 to the discharge pressure of the pump 14. Passage 30 is connected by a line 36 to the inlet to the piston actuating chamber 19 of the relief valve 10. An adjustable spring means 21 is arranged to bias diaphragm 26 to the closed position of control valve 20 shown in FIG. 1.

Pump 14 is provided with a recirculating relief valve 40 which controls the flow from the discharge to the inlet or suction side of the pump 14. Relief valve 40 has a valve member 47 operated by a piston 45 which is responsive to a control pressure applied to a piston actuating chamber 43 to move valve member 47 from a closed position (shown in FIG. 1) to an open position wherein a part of the pump discharge flow is recirculated to the inlet side (suction) of pump 14.

A control valve 81 is arranged to control operation of relief valve 40 in response to the pump discharge pressure. To this end, control valve 81 is provided with a pressure control chamber 82 which is connected by a line 84 to sense the discharge pressure of pump 14. A valve member 85 is arranged to control the flow of liquid past a valve seat 87. Valve member 85 has an internal passageway 86 communicating with control chamber 82 and a small chamber 83 adjacent the end thereof. Valve member 85 is arranged to cooperate with valve seat 87 to control flow between internal passageway 86 and a passageway 80 which is connected by line 89 to the inlet to the piston actuating chamber 43 of relief valve 40. Valve member 85 is connected to and is movable with a pressure responsive diaphragm 88. An adjustable spring means 91 is arranged to bias diaphragm 88 to the closed position of control valve 81 shown in FIG. 1.

In FIG. 3 there is shown the means by which the force applied to diaphragm 88 by spring means 91 is adjusted, it being noted that the means by which the force applied to diaphragm 26 by spring means 21 are identical. Such means are well known in the art. Thus, spring means 91 comprises a large coil spring mounted in compression between a nut 92 and a diaphragm engaging member 98. Nut 92 is threadedly mounted on a threaded shaft 100 and has a pin 94 extending radially therefrom into an axially extending slot 96 on the body of control valve 81. By this construction, when shaft 100 is rotated by means of handle 41, which is pinned to the end of shaft 100, nut 92 will not rotate with shaft 100 but will move axially thereof to change the spacing between nut 92 and member 98 and thereby adjust the mechanical spring force applied to diaphragm 88 by changing the amount the large spring is compressed.

Spring means 91 also comprises a small spring for use in increasing the spring force by adding its force to that of the large spring after the nut 92 has moved beyond a certain point in its travel toward member 98 at the valve end of control valve 81.

In the operation of the relief valve system shown in FIG. 1, the control valve 20 on the inlet side of the pump 14 works in conjunction with the control valve 81 on the discharge side of the pump 14 to give complete control over the entire system. To this end, there is provided an adjusting hand wheel (not shown) for setting the spring force acting on diaphragm 26 to close the control valve 20 and an adjusting hand wheel 41 (FIG. 3) which is arranged to vary the spring force applied to the diaphragm 88 of control valve 81 to urge the valve member 85 to the closed position. By this arrangement, the control valves 20 and 81 are set to a control pressure at which they operate their associated relief valves 10 and 40 to their open position.

Changes in the pump discharge pressure are usually handled internally by the recirculating relief valve 40. However, large pressure increases on the inlet side of the pump 14 are controlled by dumping excess pressure to atmosphere from the inlet side of the pump 14. This is accomplished in the manner described hereafter.

In the event that an excessive inlet pressure occurs on the inlet side (suction) of the pump 14, this is sensed by the control valve 20 through line 24. The high pressure is delivered to the pressure control chamber 22 and moves the diaphragm 26 against the spring force thereon to cause the valve member 23 to unseat from valve seat 28 and provide flow communication between the flow passages 30 and 32 in the control valve 20. When this occurs, water at discharge pressure flows from line 34 through passages 32 and 30 and line 36 to the piston actuating chamber 19 of relief valve 10. The discharge pressure acting on piston 15 of the relief valve is much larger than the inlet pressure acting on the valve member 16 so that the relief valve member 16 is moved to unseat and permit the inlet flow from line 12 to pass through relief valve 10 and dump to atmosphere. This dumping flow is through the inlet passage 17 of relief valve 10 past the valve member 16 and through the outlet passage 18 and, typically, will simply dump onto the ground.

At the same time, a high pump discharge pressure condition is sensed by the discharge control valve 81 through line 84 which applies the excessive discharge pressure to the pressure control chamber 82 for control valve 81. This large pressure will overcome the spring force applied to diaphragm 88 and cause valve member 85 to unseat and open the flow past the end thereof. This discharge pressure flow will then flow through a small internal passage 86 of valve member 85 and out the end thereof adjacent valve seat 87 into a small chamber 83 and past the valve seat 87 to the passageway 80 of the control valve 81. The discharge pressure flow then flows through a line 89 to the inlet of the piston actuating chamber 43 for the recirculating relief valve 40. The discharge pressure acting on the piston 45 of relief valve 40 to open the recirculating relief valve member 47 will produce a force which is greater than the force produced on the valve member 47 tending to close the same because of the difference in pressure areas. Thus, relief valve 40 is opened and a portion of the discharge flow from pump 14 is recirculated to the inlet side (suction) thereof.

Figure 2:
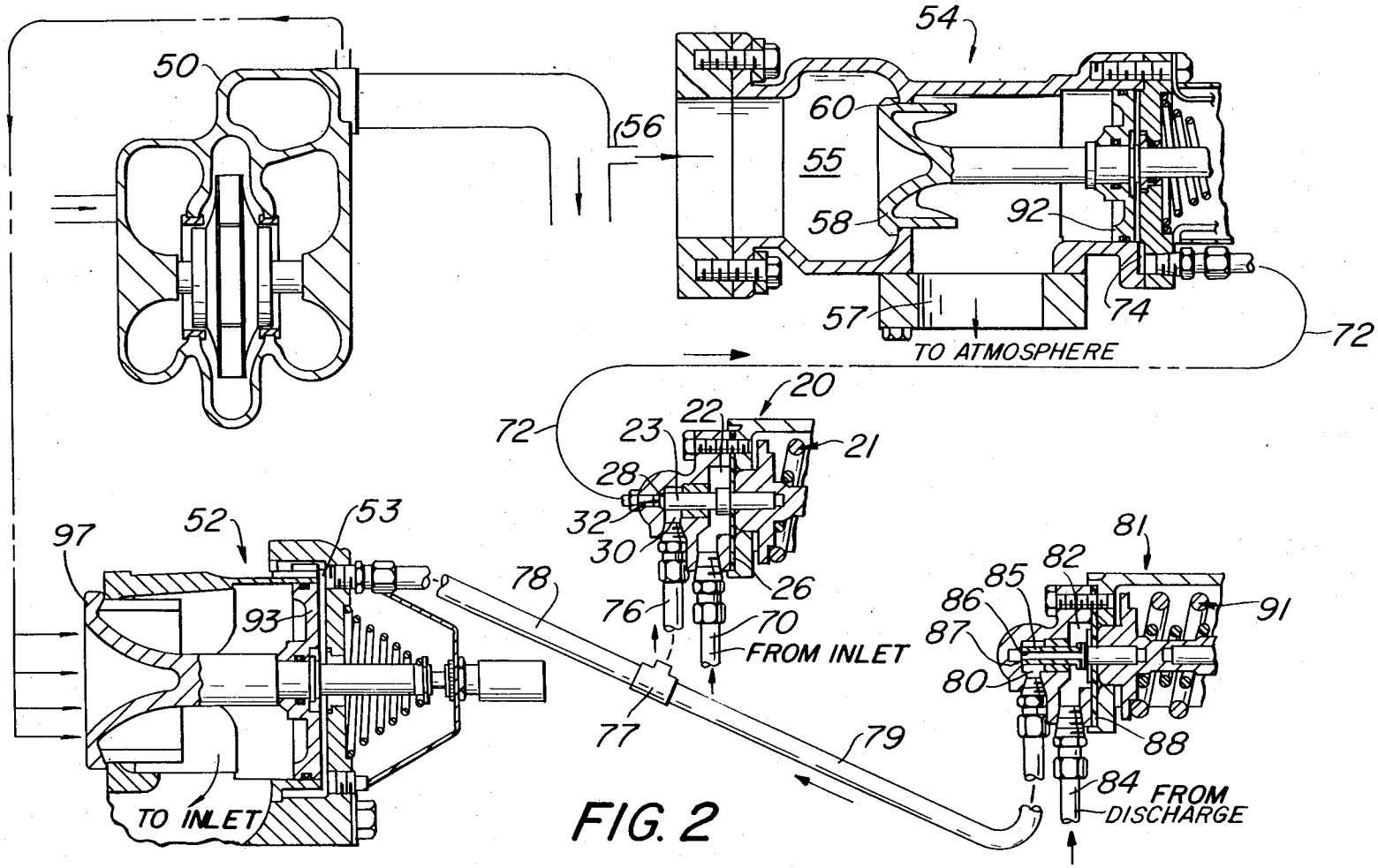
FIG. 2 is a schematic illustration of another relief valve system in accordance with the invention.

Another relief valve system in accordance with the invention is shown in FIG. 2. In this system, a centrifugal pump 50 is provided with a recirculating relief valve 52 (similar to relief valve 40) for providing flow between the discharge and the inlet side (suction) of the pump 50 in response to a first excessive pressure condition sensed on the discharge side of the pump. There is also provided a dump relief valve 54 (similar to relief valve 10) located on the discharge side of the pump 50.

The recirculating relief valve 52 has a valve member 97 operated by a piston 93 which is responsive to a control pressure applied to a piston actuating chamber 53 to move valve member 97 from a closed position (shown in FIG. 2) to an open position wherein a part of the pump discharge flow is recirculated to the inlet side (suction) of pump 50.

The relief valve 54 has an inlet chamber 55 communicating with the pump discharge flow (by way of a line 56) and a valve member 58 operated by a piston 92 and cooperating with a valve seat 60. In the closed position of the relief valve 54 (shown in FIG. 2) flow is prevented between the inlet chamber 55 and a dump passage 57 on the downstream side of valve seat 60. Piston 92 is responsive to a control pressure applied to a piston actuating chamber 74 to move valve member 58 from the closed position to an open position wherein part of the discharge flow passes from inlet chamber 55 to dump passage 57 and to atmosphere.

In this system, there is provided control valves 20 and 81 for controlling the operation of the two relief valves 52 and 54. The control valve 20 is associated with the inlet side (suction) of the pump 50 and the control valve 81 is associated with the discharge side of the pump 50.

Control valve 20 comprises a valve member 23 cooperable with a valve seat 28 for providing flow communication between a pair of flow passages 30 and 32. Valve member 23 is connected to a diaphragm 26 for movement therewith in response to the pressure condition in a pressure control chamber 22. The pressure control chamber 22 is connected by a line 70 to sense the pressure on the inlet side (suction) of the pump 50. The passageway 32 is connected by a line 72 to the piston actuating chamber 74 for the dump relief valve 54 and the passageway 30 connected by a line 76 to a tee 77 which is connected by a line 78 to the piston actuating chamber 53 for the recirculating relief valve 52. Tee 77 is connected by a line 79 to passageway 80 in control valve 81.

Control valve 81 has its pressure control chamber 82 connected by line 84 to sense the discharge pressure of the pump 50 and its valve member 85 arranged to control the flow past the valve seat 87. Valve member 85 has an internal passageway 86 communicating with control chamber 82 and a small chamber 83 adjacent the end thereof. Valve member is arranged to cooperate with valve seat 87 to control flow between internal passageway 86 and passageway 80. Valve member 85 is connected to and movable with a pressure responsive diaphragm 88 and is biased to a closed position by an adjustable spring means 91.

In the operation of the relief valve system shown in FIG. 2, the control valve 20 on the inlet side of the pump works in conjunction with the discharge control valve 81 to give complete control over the entire system, the force provided by spring means 21 and 91 being adjusted so that control valves 20 and 81 are set to a control pressure at which they operate their associated relief valves 54 and 52, respectively, to their open position.

Small changes in the pump pressure are usually handled internally by the recirculating relief valve 52. However, large pressure changes on either the inlet or discharge side of the pump 50 are controlled by dumping excess pressure to atmosphere from the discharge side of the pump 50. This is accomplished in the manner described hereinafter.

In the event that there is a large increase in the inlet pressure, whereby a corresponding large increase would also occur in the discharge pressure, this excessive discharge pressure condition is sensed by the discharge control valve 81 through line 84 which applies the excessive discharge pressure to the pressure control chamber 82 for the discharge control valve 81. This large pressure will overcome the spring force applied to the diaphragm 88 and cause the valve member 85 to unseat and open the flow past the end thereof. This discharge pressure flow will then flow through the small internal passage 86 of the valve member 85 and out the end thereof adjacent the valve seat 87 into a small chamber 83 and past the valve seat 87 to the passageway 80 of the control valve 81. The water at discharge pressure then flows through line 79, tee 77 and line 76 into the passage 30 of the control valve 20. At the same time, the high discharge pressure flow passes through line 78 into the piston actuating chamber 53 for the recirculating relief valve 52. The high pressure acts on the piston 93 to open the recirculating relief valve 52.

When the high inlet (suction) pressure is communicated through line 70 to the pressure control chamber 22 of control valve 20, the valve member 23 is moved away from the valve seat 28 to provide flow communication from the passageway 30 past the valve seat 28 to the passageway 32. When this occurs water at the discharge pressure of the pump 50 flows through line 72 to the piston actuating chamber 74 of the dump relief valve 54. This discharge pressure acts on the piston 92 to overcome the smaller discharge pressure force in chamber 55 acting to close the valve member 58 whereupon valve member 58 moves away from its valve seat 60 to provide flow communication between the inlet chamber 55 and the dump passage 57. Accordingly, the discharge flow through line 56 passes through the relief valve 54 and is dumped to atmosphere.

When the two relief valves 52 and 54 are operated as described above, any high pressure condition on the pump 50 will be reduced. When the pressure reduction is sufficient to return the pump 50 to normal pressure conditions, the discharge pressure applied to the discharge control valve 81 allows the valve member 85 to return to the closed position. Also, the inlet pressure through line 70 to the pressure control chamber 22 of the control valve 20 allows the valve member 23 to move to the closed position thereby cutting off the communication of the discharge pressure to the pressure control chamber 74 of the dump relief valve 54. When this occurs, both the relief valves 52 and 54 are returned to their closed positions.

To summarize, by setting the control valve 20 for the dump relief valve at the system output pressure and the control valve 81 for the recirculating relief valve at a lower control pressure, as the pump pressure increases the control valve 20 will be opened (to thereby actuate the dump relief valve to an open position) after the control valve 81 has been opened (to thereby actuate the recirculating relief valve to an open position). Also, as the pump pressure decreases from the set system pressure, the control valve 20 will close before the control valve 81 closes.

The relief valve system of invention is designed so that the inlet and discharge sides of the pump can have their own pressure settings and, by providing suitable bypass valving for the dump relief valve, during an initial relay hook-up, the system can monitor the inlet pressure and not allow it to exceed the pressure its senser is preset for. Once the relay hook-up has been completed, the system can be switched over to total system control and both the recirculating and dump relief valves will be controlled by the setting of their associated control valves.

What is claimed is:

1. A relief valve system for controlling the pressure on both the inlet and discharge sides of a pump having a pump inlet having liquid supplied thereto at a first pressure and a pump discharge for delivering liquid at a second pressure higher than the first pressure, comprising:

a first relief valve for dumping pumping liquid to atmosphere, a second relief valve for recirculating liquid from the discharge side back to the inlet side of the pump, and control means operating said second relief valve to cause liquid to be recirculated from the discharge side back to the inlet side of the pump in response to the occurrence of a first excessive pressure condition on said pump and operating said first relief valve to cause liquid to be dumped to atmosphere in response to the occurrence of a second excessive pressure condition on said pump, whereby said control means can respond to substantial and abrupt changes in demand on said pump to relieve said pump from excessive pressure conditions even under operating conditions where the pump supply pressure is not considerably less than the pump discharge pressure.

2. A relief valve system according to claim 1 wherein said first relief valve is in flow communication with the flow to the inlet side of said pump and is operative to dump a portion of the inlet flow to atmosphere in response to the occurrence of said second excessive pressure condition.

3. A relief valve system according to claim 2 wherein said control means comprises a first control valve for actuating said first relief valve to dump a portion of the inlet flow to atmosphere in response to sensing the occurrence of said second excessive pressure on the inlet side of said pump.

4. A relief valve system according to claim 3 wherein said control means includes a second control valve for actuating said second relief valve to recirculate liquid from the discharge to the inlet side of said pump in response to sensing the occurrence of said first excessive pressure on the pump discharge.

5. A relief valve system according to claim 1 wherein said first relief valve is in flow communication with the flow from the discharge of said pump and is operative in response to the occurrence of said second excessive pressure condition for dumping a portion of the discharge flow to atmosphere.

6. A relief valve system according to claim 5 wherein said control means includes a first control valve for actuating said first relief valve to dump a portion of the discharge flow to atmosphere in response to sensing the occurrence of said second excessive pressure on said inlet side of said pump.

7. A relief valve system according to claim 6 wherein said control means includes a second control valve for actuating said second relief valve to recirculate liquid from the discharge to the inlet side of said pump in response to sensing the occurrence of said first excessive pressure on the discharge side of said pump.

8. A relief valve system according to claim 4 wherein said first control valve comprises a valve member operable to control flow between a pair of passages, one of said passages being connected to the discharge flow from said pump and the other of said passages being connected to the piston actuating chamber for said first control valve for controlling operating thereof.

9. A relief valve system according to claim 8 wherein said second control valve comprises a valve member for controlling flow between a pair of passages, one of said passages connected to the pump discharge and the other said passages being connected to the piston actuating chamber for said second control valve for controlling operation thereof.

10. A relief valve system according to claim 7 wherein said first control valve comprises a valve member for controlling flow between a pair of passages therein, one of said passages being connected to a flow line to which the discharge pressure may flow, and the other of said passages being connected to the piston actuating chamber for the first relief valve.

11. A relief valve system according to claim 10 wherein said second control valve comprises a valve member for controlling flow between a pair of passages, one of said passages being connected to the discharge flow and the other of said passages being connected to said flow line to which the second passage of said first control valve is connected, said flow line also being connected to the piston actuating chamber of the second relief valve for controlling operation thereof.

12. A relief valve system according to claim 1 wherein the pump pressure at said first excessive pressure condition is less than the pump pressure at said second excessive pressure condition whereby said control means is operative to recirculate flow at a lower pressure condition of said pump than the pressure condition of said pump at which said control means is operative to dump flow to atmosphere.

13. A relief valve system according to claim 12 wherein said control means includes a first control valve for actuating said first relief valve to a flow dumping condition, said first control valve being constructed and arranged to be manually adjustable to operate at various set pressure conditions to actuate said first relief valve to said flow dumping condition.

14. A relief valve system according to claim 13 wherein said control means includes a second control valve for actuating said second relief valve to its flow recirculating condition, said second control valve being constructed and arranged to be manually adjustable to operate at various set pressure conditions to actuate said second relief valve to said flow recirculating condition.

* * * * *